US006863270B2

(12) United States Patent
Bartley, Jr.

(10) Patent No.: US 6,863,270 B2
(45) Date of Patent: Mar. 8, 2005

(54) ADJUSTABLE POSITIONING DEVICE FOR CABINETS AND CONSTRUCTION PANELS

(76) Inventor: Jack Churchill Bartley, Jr., 167 Tristen La., Henderson, NC (US) 27537

( * ) Notice: Subject to any disclaimer, the term of this patent is extended or adjusted under 35 U.S.C. 154(b) by 0 days.

(21) Appl. No.: 10/385,025

(22) Filed: Mar. 10, 2003

(65) Prior Publication Data

US 2003/0178759 A1 Sep. 25, 2003

Related U.S. Application Data

(60) Provisional application No. 60/365,683, filed on Mar. 19, 2002.

(51) Int. Cl.[7] ..... B25B 1/20
(52) U.S. Cl. ..... 269/37; 269/69; 269/904
(58) Field of Search ..... 269/904, 69, 37; 248/354.5; 254/133 A, 94, 422, 10 R, 10 B, 10 C; 108/144.11, 147.2, 147.22, 129, 130; 414/744.2, 744.3

(56) References Cited

U.S. PATENT DOCUMENTS 497,952 A * 5/1893 Davis ..... 254/10 R
1,098,639 A * 6/1914 Richards ..... 254/94
1,183,970 A * 5/1916 Gray ..... 254/10 B
3,204,910 A * 9/1965 Gacher ..... 248/354.5
3,744,757 A * 7/1973 White et al. ..... 254/94
4,123,038 A * 10/1978 Meyers ..... 254/134
4,331,324 A * 5/1982 Andary ..... 254/2 R
4,723,756 A * 2/1988 Stumpf, Jr. ..... 254/134
4,848,732 A * 7/1989 Rossato ..... 254/10 R
5,169,219 A * 12/1992 Obbink ..... 248/354.3
5,609,332 A * 3/1997 Hassell ..... 269/904
5,868,099 A * 2/1999 Begin ..... 269/152
5,979,854 A * 11/1999 Lundgren et al. ..... 248/354.5
5,979,878 A * 11/1999 Blankenship ..... 254/10 C
6,322,062 B1 * 11/2001 Conn et al. ..... 254/134
6,505,803 B1 * 1/2003 Hernandez ..... 248/354.5
6,575,432 B1 * 6/2003 Oronoz ..... 254/126

* cited by examiner

*Primary Examiner*—Robert C. Watson

(57) ABSTRACT

An adjustable positioning apparatus for either cabinet, work-pieces or construction panels. Methods of use are disclosed. The apparatus can be used to hold and make adjustments to work-piece in precisely the facilitating position to be permanently affixed to the wall studs or ceiling joists. The adjustability of the apparatus enables one to support and position work pieces in their permanent positions at different elevations and can be quickly removed and readjusted for other elevations and different construction procedures.

8 Claims, 9 Drawing Sheets

ADJUSTABLE POSITIONING DEVICE FOR CABINETS AND CONSTRUCTION PANELS

CROSS REFERENCE TO RELATED APPLICATION

This application claims the benefits of Provisional Patent Application Ser. No. 60/365/683 filed on Mar. 19, 2002.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The art of hanging cabinet workpieces and construction panels on walls and ceilings has been a hazardous, cumbersome activity. In order to secure cabinets,workpieces and panels, typically more than one worker is needed. One or two workers hold the cabinet, workpieces or panels up to the wall or ceiling while another worker secures the cabinet, workpieces or panel in it's final installed location. This method is time consuming and costly. If only one worker is needed to perform the same operation time and labor costs could be reduced and produce the same results.

It is known that using different sizes and heights of sticks to prop up wall cabinets is not a safe or stable way of installation. Past inventions involving hydraulic and screw jacks have proven to be very bulky, complex to use and transport and have too many parts.

Therefore, it is desirable to provide a simple, low cost, lightweight, easily adjustable and safe method of installing or removing wall cabinet, workpieces and construction panels with great agility and ease.

The construction industry for many years has been in pursuit of a way to hold and support workpieces to make final adjustment of articles such as cabinets, ceiling frames, panels and beams for securement to wall and ceiling.

In prior art U.S. Pat. No. 4,482,130, issued Nov. 13, 1984, entitled "Vertical Lifting and Placing Apparatus" it shows that one must place a workpiece on a single platform and raise workpiece by pushing down on a tube having a handle. This shows that there is no means of adjustability within the device without placing a shim between platform and workpiece. U.S. Pat. No. 4,715,760 has the same problem of final adjustment in a horizontal position. U.S. Pat. No. 6,322,062 shows a base, a top platform and a hydraulic jack, but shows no means of variations for other related workpieces other than a single wall cabinet. U.S. Pat. No. 4,981,288 issued Jan. 1, 1991 shows device used by first having a base cabinet secured and the device clamped and sitting on a counter top thus limiting it's versatility for other construction related tasks. U.S. Pat. Nos. 1,725,329; 5,329,744; 2,242,380; 5,979,854; 4,715,760; 4,955,592 and 4,482,130 show one main vertical support member.

None of the prior art show a lifting and positioning device that has four main vertical support members in it's system, and two separate workpiece holders, excluding U.S. Pat. No. 4,955,592 issued Sep. 11, 1990 by Richard Brennan, Sr. Therefore none of the known prior art devices show that it is a multi-purpose workpiece holder capable of being used in multiple construction practices. In addition, many of the prior art lacked simplicity and a light weight capability.

BRIEF SUMMARY OF THE INVENTION

The invention is an adjustable positioning device used to install cabinets, workpieces and construction panels. The main objective of this invention is to provide a new, inexpensive, lightweight and easily portable, simple way of installing cabinet workpieces and construction panels.

This invention has 4 (four) primary parts: a base and top platform (a top platform for holding cabinet workpieces and panels and a bottom platform for ground surface stability); a square tub member longitudinal; and a second square tub member longitudinal with adjustable capabilities.

Typical devices being used to install cabinet workpieces and panels are very complicated in design, unlike this invention which is simple to use and understand. This device can easily be adjusted for different elevations by removing pins and simply raising or lowering the top platform which is fastened to an adjustable longitudinal member to desired elevation and replacing pins. This procedure has normally required a hydraulic jack but is not necessary with this invention.

DETAILED DESCRIPTION OF THE INVENTION

The present invention shown in FIG. 1 will be described fully with the following detailed description. The invention is illustrated by ways of example, not by means of limitations. Persons skilled in the art may modify the invention in this embodiment and the accompanying drawings and shall be interpreted as illustrative and not as limitations of the present invention.

Figure 1:
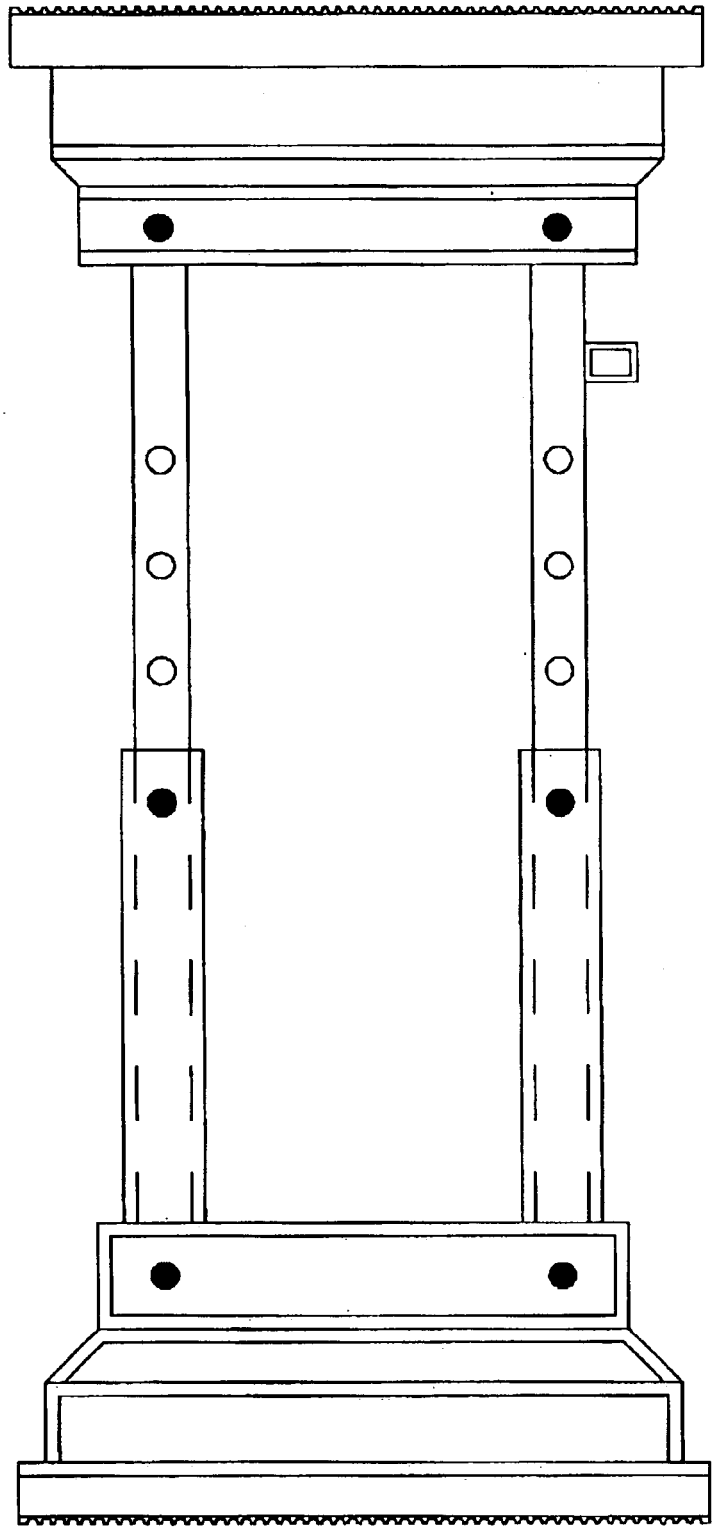
FIG. 1 is a perspective left side elevation view of an adjustable positioning device.
Figure 2:
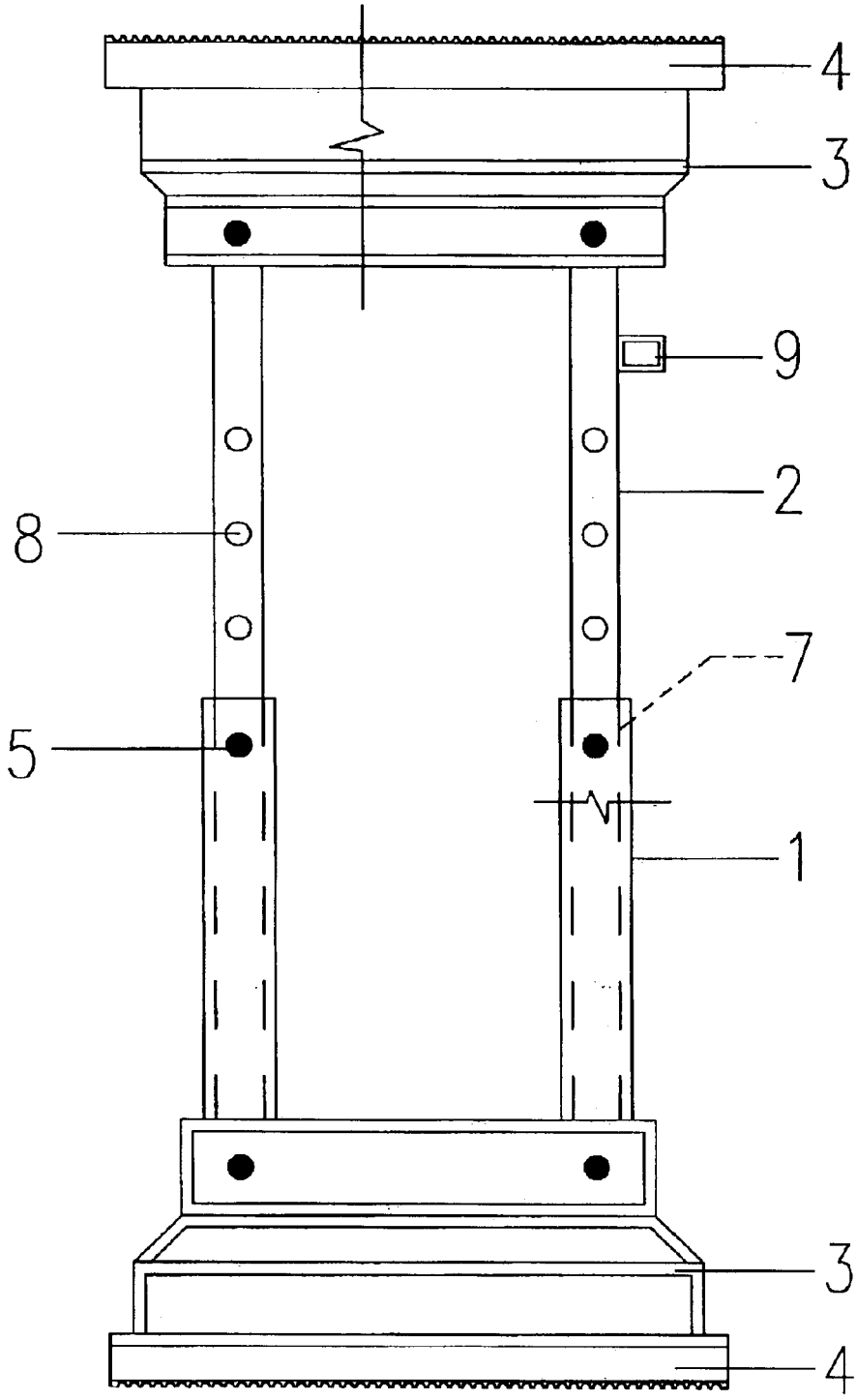
FIG. 2 is a right side elevation view of an adjustable positioning device.
Figure 14:
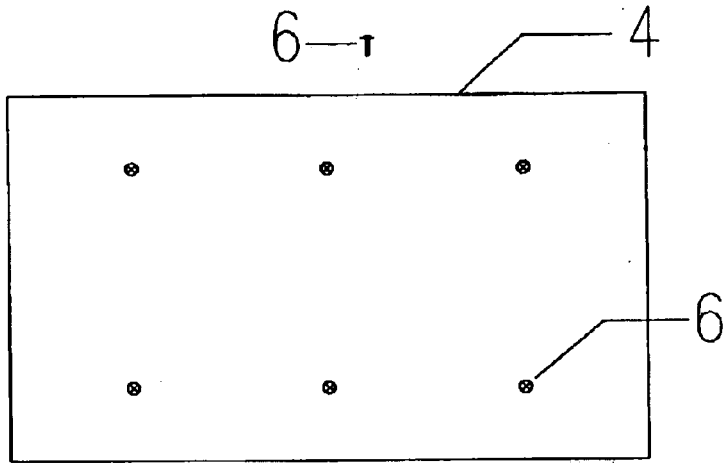
FIG. 14 is a top plain view of a top and bottom platform of an adjustable positioning device.
Figure 15:
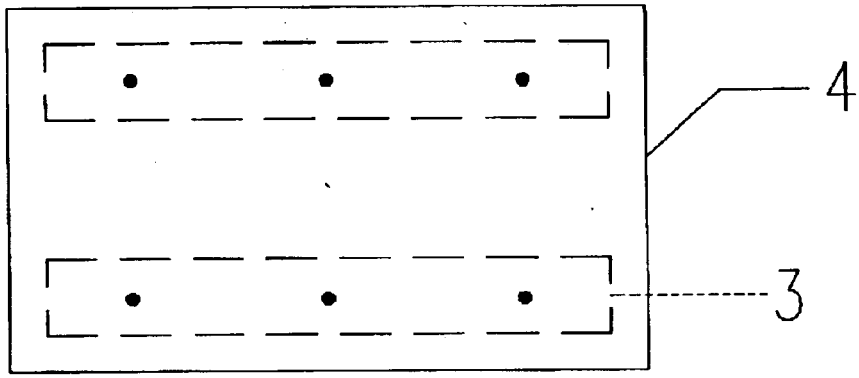
FIG. 15 is a top view of a top and bottom platform attached to the upper and lower supports of an adjustable positioning device.
Figure 16:
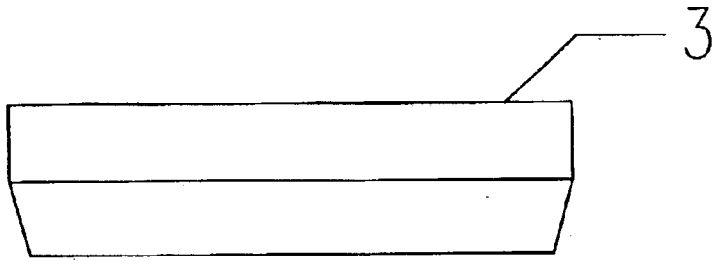
FIG. 16 is a perspective view of a single upper and lower support of an adjustable positioning device.

The adjustable positioning device according to this preferred embodiment of the present invention is designated in FIG. 1. Referring now to FIG. 2 of the drawing, the device is to include two vertical strut like members shown as parts 1 & 2 having adjustable means and a top and bottom work holder piece 3 which is mounted to vertical members 1 & 2. Part 3 shown as a base has securement plate 4 secured as by screws 6, best seen in FIGS. 14 & 15.

Figure 18:
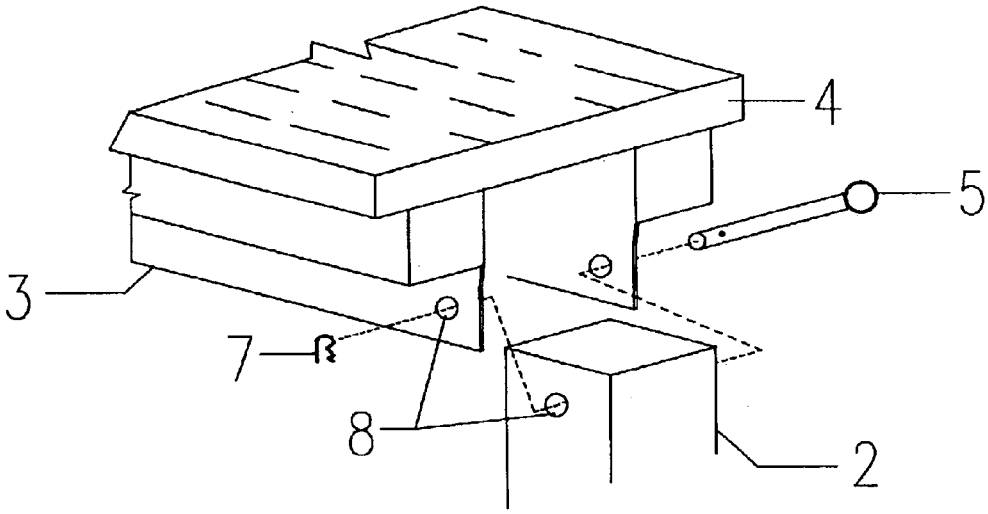
FIG. 18 is a cross section view of a top and bottom workpiece holder with means of securement to vertical members.

Referring to FIG. 18 shows means of securing 3 to 1 & 2 of a top or bottom workpiece holder by lining up all said holes and holes being a ¼" bored hole or more preferably ⅝" from one side to opposite side.

Installing 5 through holes 8 by inserting 7 to retain 5. In the preferred embodiment the top and bottom sections can best be seen in FIG. 13 as labeled 3&4 are by construction are identical in shape and size.

Figure 12:
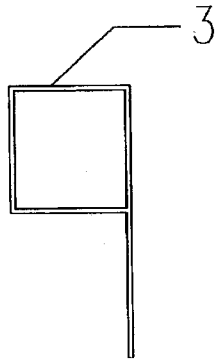
FIG. 12 is a side plain view of a top platform support as shown in FIG. 6 of an adjustable positioning device.

For example in the preferred embodiment, the top and bottom workpiece holders 3 are best seen in FIGS. 2–13–18, is preferably 13" to 24" in length when 4 is secured to 3 best shown in FIGS. 15–18 and preferably from 4" in height to 6" in height as 3 is a square box tubing with one side protruding preferably 2" past the bottom of box tubing and ⅛" thick to about ¼", more preferably 3⁄16" thick best seen in FIG. 12.

The workpiece holder 3 is securely attached to vertical members 1–2 by means set forth, thus giving this preferred embodiment it's means of stability. Members 1–2 can best be seen in FIG. 2 (1–2) being a square tube having an overall length of 6' to 7', more preferably 4'8",2 having an outside dimension of ¾" or about 1" more preferably 1¼" and should be of a light weight aluminum alloy or strong walled plastic or PVC.

Figure 9:
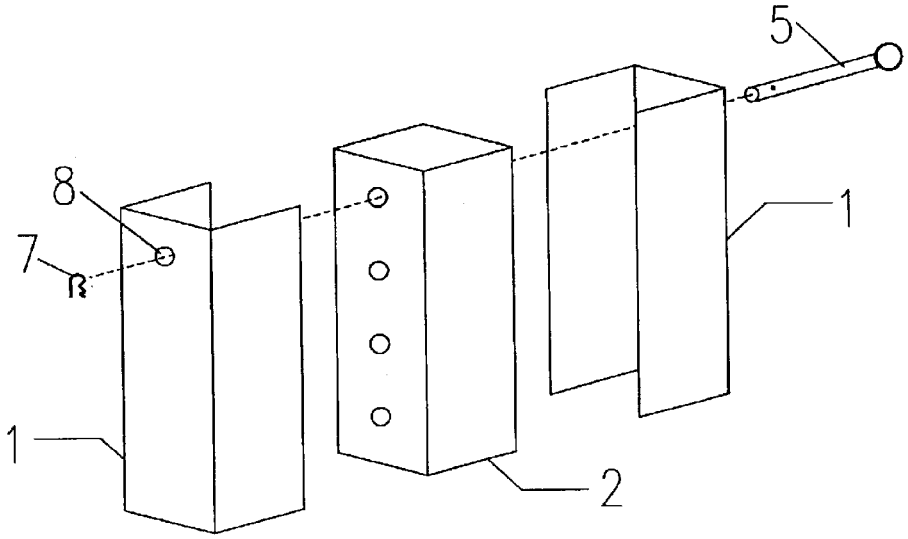
FIG. 9 is a cross section view of an upper and lower member adjustable securement of an adjustable positioning device.
Figure 10:
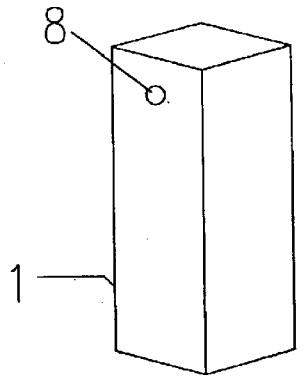
FIG. 10 is a perspective view of a lower member of an adjustable positioning device.

Vertical member 1, holes 8 are bored from one side of tube or to opposite side of member. 8 being a ¼" bore, more preferably ⅝", as best seen in FIGS. 9 & 10 . Holes are bored approximately 1¼" from the top of member 1. This hole is to secure 3 as best seen in FIG. 18.

Referring now to FIGS. 2–11 of the drawings square tube 2 preferably of aluminum alloy, a strong walled plastic or PVC having an inside diameter of ¾" or about 1" preferably 1¼". The vertical member 2 will receive 1 coaxially with each of the stabilizing vertical members 1 best seen in FIGS. 1–2. Each of the stabilizing members 1–2 have an upper and lower workpiece holder secured at opposite ends. The upper workpiece holder 3 is to support a workpiece best seen in FIG. 17. The lower workpiece holder 3 is to give the preferred embodiment it's means of stabilizing vertically to a ground surface, best seen in FIG. 17.

Figure 11:
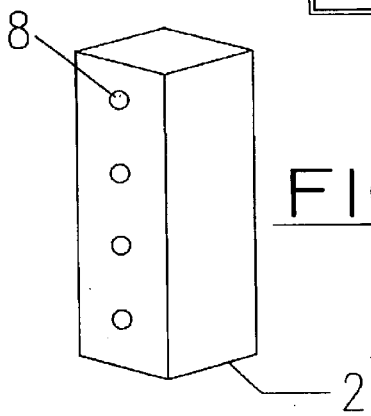
FIG. 11 is a perspective view of an upper member of an adjustable positioning device.
Figure 17:
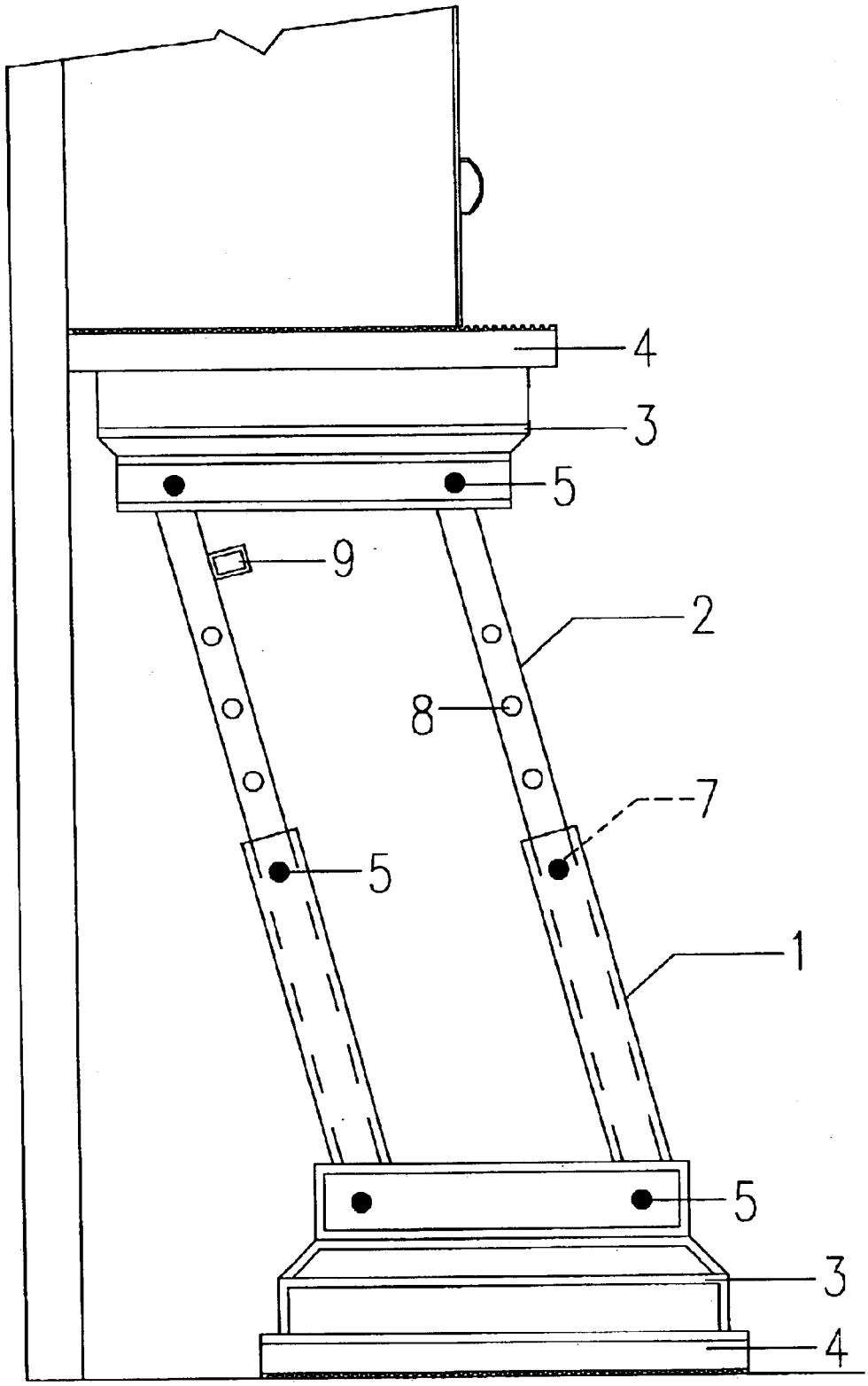
FIG. 17 is a perspective view of how an adjustable positioning device might look in actual installation of a cabinet or construction panel in the work place.

In further accordance with the invention both upper and lower plates 4 have a non skid surface made of appropriate compound best seen in FIGS. 2 & 17. As best seen in FIGS. 2 & 11 vertical member 2 having multiple holes bored along it's vertical axis from one side to opposite side, spaced at 1" to about 1½" more preferably 3", giving this preferred embodiment a means of adjustability by aligning bored holes on 1–2 at a predetermined elevation and placing 5 through bored holes and locking 5 with clip 7 best shown in FIGS. 3 & 4 creating a telescopic member.

Figure 13:
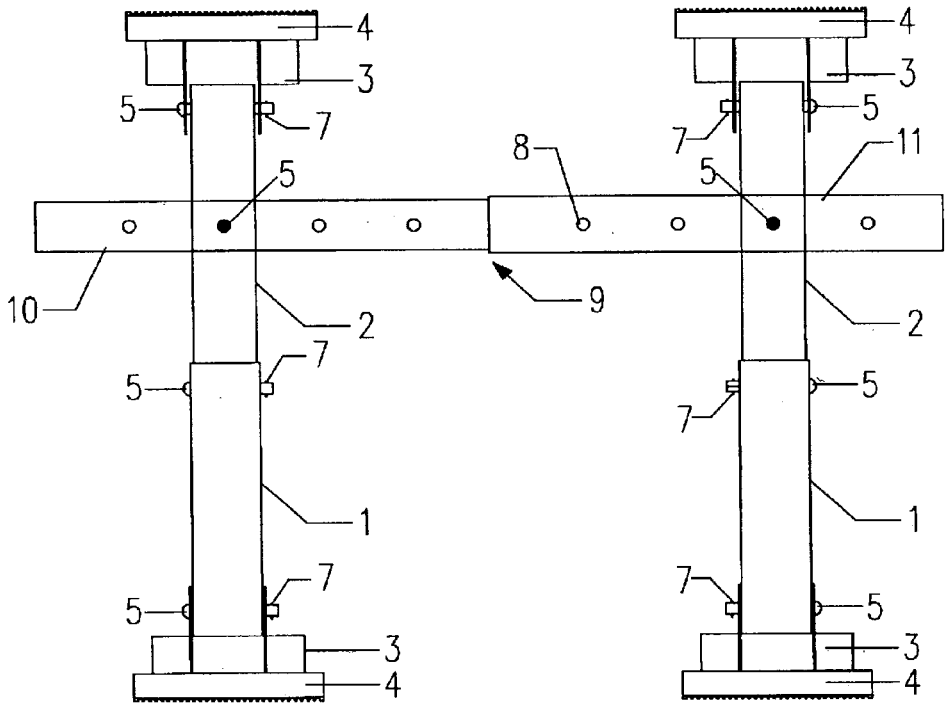
FIG. 13 is a plain view of a pair of adjustable positioning devices with a stabilizing bar attached.

As shown in FIG. 13 a stabilizing bar 9 connects two workpiece holders as to allow a wide workpiece to be supported prior to being fastened to it's permanent location. The stabilizing bar is box tubing having one side with an outside measurement of the same or less, as the opposite box tubing inside measurement. Having bored holes through it's horizontal surface 10–11 from front to back, holes to be spaced 1" or between 1½" most preferably 3".

Figure 3:
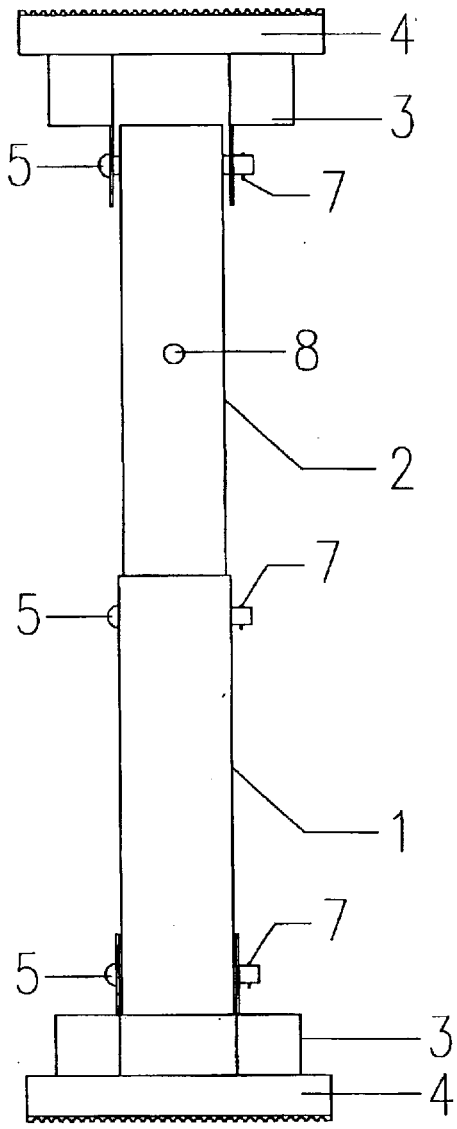
FIG. 3 is a front elevation view of an adjustable positioning device.
Figure 4:
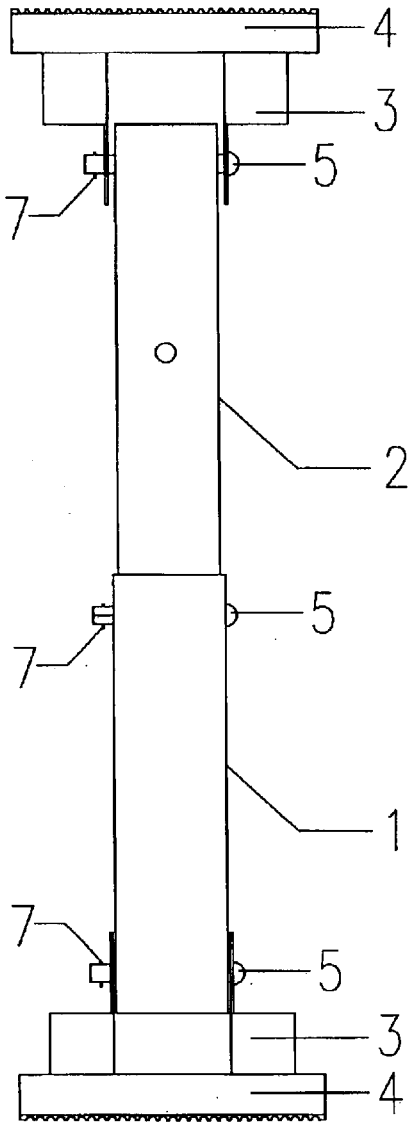
FIG. 4 is a rear elevation view of an adjustable positioning device.
Figure 5:
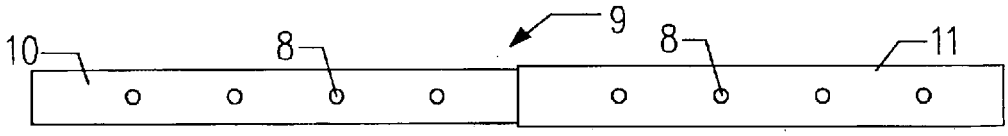
FIG. 5 is a plain view of a stabilizing bar for an adjustable positioning device, which is optional.
Figure 6:
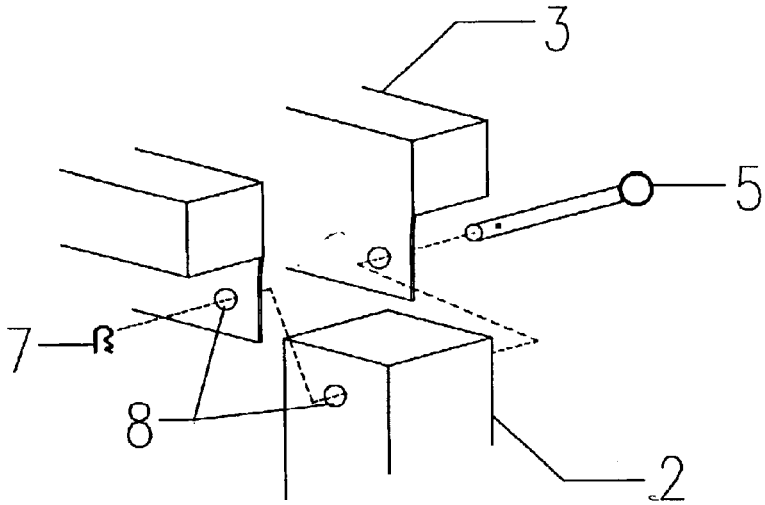
FIG. 6 is a cross section view of a top and bottom platform support of an adjustable positioning device.
Figure 7:
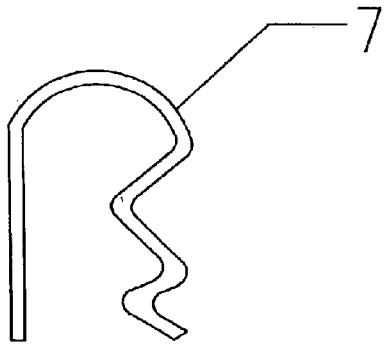
FIG. 7 is a side view of a retaining clip of an adjustable positioning device.
Figure 8:
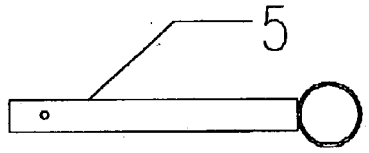
FIG. 8 is an exploded view of a securement means of all securable parts of an adjustable positioning device.

To attach stabilizing bar 9–10–1 the upper members 2, a bored hole from front to back on 2 will be lined up with stabilizing bar holes and parts 5–7 will be means of securement to 2, as best seen in FIGS. 3–4–13. Both stabilizing bar tubes are locked by lining up holes on it's horizontal surfaces and placing 5 in bored holes and locking 5 with clip 7 forming a telescopic member, best shown in FIGS. 5–13. In FIG. 5 part 9 is a combination of parts 10–11, in this preferred embodiment.

The overall height of the present invention in this preferred embodiment in it's lowered state varies with the height of the workpiece to be installed and the height from the floor or a solid secured surface, as the invention could be modified to have a vertical height from as low as 10" to a height of 12' as there are no limitations relative to height of the invention.

In further accordance with the invention the complete workpiece holder system best seen in FIGS. 1–13, having 4 vertical members with means of adjustability. 4 workpiece holders at opposite ends of vertical members and a stabilizing bar with means of adjustability attached to workpiece holder horizontally as best seen in FIGS. 1–13.

The device of the present invention is used by placing the base member of two workpiece holders on a suitable solid secure surface and placing opposite ends 3 against a solid horizontal wall surface at desired elevations and width keeping plumb with base member of workpiece to be installed. Attach the stabilizing bar member to both devices with pin 5 and secure with clip 7. Place workpiece on workpiece holders 3 level and position. By striking bottom member toward wall with solid object this enables one to position and level workpiece. Then secure to wall or ceiling with appropriate fasteners and to adjoining workpieces if applicable.

Remove devices by striking bottom member outwards from the horizontal wall surface. Placing one hand on the bottom of uppers 3, relocating devices at the next location where a workpiece is to be installed if applicable. When having workpieces at different elevations adjust the devices by removing 7–5 on the vertical members and raising or lowering top 3 workpiece holder by placing your hand on the bottom side of 3 and aligning holes on members 1–2 at desired elevation. Reinstall 5–7. Repeat operation as stated above in the preferred embodiments if applicable.

Numerous variations will occur in the present invention without departing from the intended scope, for example the vertical members could be rectangular, square, round or other shapes. The top and bottom workpieces could be other than rectangular, such as circular, or triangular and any given length. The materials used could vary extensively as long as the materials used are structurally appropriate for the function they are to perform.

The invention is to be given it's fullest interpretation within the terms of the preferred embodiment and as defined by the appended claims.

What I claim as my invention is:

1. An adjustable positioning device for installing cabinets, workpieces and construction panels, said device comprising:

a top platform and a base platform, each said platform having an upper surface and lower surface;

a first pair of parallel supports medially attached to the lower surface of said top platform and a second pair of parallel supports medially attached to the upper surface of said base platform, wherein each support of said first pair of parallel supports is constructed of square box tubing having one side protruding downward from the box tubing and each support of said second pair of parallel supports members is constructed of square box tubing having one side extending upward from the box tubing, each downwardly protruding side of said first pair of supports and each upwardly extending side of said second pair of supports defines an aligned hole therein at opposite ends thereof;

a first pair of tubular strut members depending from said top platform and a second pair of tubular strut members extending upwardly from the base platform, each strut member of said first pair of strut members having a top end and a bottom section and each strut member of said second pair of strut members having a top section and a bottom end, wherein the bottom section of each strut member of said first pair of strut members telescopingly engages the top section of each strut member of said second pair of strut members to define an adjustable height between the base platform and the top platform;

mean for pivotally securing each top end of said first pair of strut members and each bottom end of said second pair of strut members respectively to said first pair of supports and said second pair of supports; and means for adjusting the height between the base platform and the top platform.

2. The adjustable positioning device according to claim 1, wherein each said top end of the first pair of strut members and each said bottom end of the second pair of strut members defines a bored hole therein.

3. The adjustable positioning device according to claim 2, wherein said pivotally securing means includes a pin passing through the aligned hole of each of said first and second pair of supports and the bored hole of each of said first and second pair of strut members, each said pin being retained by a clip.

4. The adjustable positioning device according to claim 1, wherein each strut member of said first pair of tubular strut members defines a plurality of vertically aligned holes therein and the top section of each strut member of said second pair of tubular strut members includes a single throughbore.

5. The adjustable positioning device according to claim 4, wherein said height adjusting means includes a pin passing through a selected one of the plurality of vertically aligned holes in each strut member of said first pair of tubular strut members and the single throughbore in each strut member of said second pair of tubular strut members, each said pin being retained by a clip.

6. The adjustable positioning device according to claim 1, wherein each said strut member is constructed of square tubing made of a material selected from the group consisting of aluminum alloy, a strong walled plastic and PVC.

7. The adjustable positioning device according to claim 1, wherein said top platform and a base platform have a rectangular configuration and are of equal dimensions.

8. The adjustable positioning device according to claim 1, wherein the top surface of said top platform and the bottom surface of said base platform are covered with a non-skid material.

* * * * *